US006101680A

United States Patent [19]

Näf et al.

[11] Patent Number: 6,101,680

[45] Date of Patent: Aug. 15, 2000

[54] CARD FLAT FOR A TEXTILE CARD MACHINE

[75] Inventors: Beat Näf, Jona; Theodore Gresser Götz, Winterthur; Jürg Faas, Andelfingen, all of Switzerland

[73] Assignee: Maschinenfabrik Rieter AG, Winterthur, Switzerland

[21] Appl. No.: 09/143,885

[22] Filed: Aug. 31, 1998

[30] Foreign Application Priority Data

| | | | |
|---|---|---|---|
| Sep. 12, 1997 | [CH] | Switzerland | 2154/97 |
| Oct. 1, 1997 | [CH] | Switzerland | 2303/97 |
| Dec. 5, 1997 | [CH] | Switzerland | 2816/97 |

[51] Int. Cl.[7] ..... D01G 15/02

[52] U.S. Cl. ..... 19/102; 19/104; 19/113

[58] Field of Search ..... 19/102, 103, 104, 19/110, 111, 113, 114, 98, 99, 105, 112

[56] References Cited

U.S. PATENT DOCUMENTS

| | | | |
|---|---|---|---|
| 2,785,443 | 3/1957 | Van Den Abeele | 19/113 |
| 3,793,677 | 2/1974 | Bechtel, Jr. | 19/113 |
| 3,808,640 | 5/1974 | Graf . | |
| 4,356,597 | 11/1982 | Graf . | |
| 4,553,288 | 11/1985 | Schneider et al. . | |
| 4,827,573 | 5/1989 | Kuehl . | |
| 5,142,741 | 9/1992 | Demuth et al. . | |
| 5,542,154 | 8/1996 | Demuth et al. . | |

FOREIGN PATENT DOCUMENTS

| | | | |
|---|---|---|---|
| 0091986 | 10/1983 | European Pat. Off. . | |
| 0422838 A2 | 4/1991 | European Pat. Off. . | |
| 0753610 A1 | 1/1997 | European Pat. Off. . | |
| 0787841 A1 | 8/1997 | European Pat. Off. . | |
| 0866153 A1 | 9/1998 | European Pat. Off. . | |
| 890870 | 11/1941 | France . | |
| 1176435 | 4/1959 | France | 19/114 |
| 588694 | 3/1959 | Germany . | |
| 1106653 | 5/1961 | Germany . | |
| 3318580 A1 | 11/1984 | Germany . | |
| 357658 | 11/1961 | Switzerland . | |
| 1687 | 2/1888 | United Kingdom | 19/113 |
| 11385 | 4/1899 | United Kingdom | 19/113 |
| 1500106 | 2/1978 | United Kingdom . | |
| 2258471 | 2/1993 | United Kingdom . | |

OTHER PUBLICATIONS

EPO Search Report, Jan. 12, 1999.

Co–Pending U.S. Application Serial No. 09/028,425.

*Primary Examiner*—Michael A. Neas
*Assistant Examiner*—Gary L. Welch
*Attorney, Agent, or Firm*—Dority & Manning

[57] ABSTRACT

A flat of a revolving flat card is provided with a clothing the points of which are subdivided into groups. The flat preferentially presents an area provided with clothing of a length of more than 1000 mm. The groups each may present a "heel", or a clothing plane each respectively, facing the main drum. The groups can be formed by respective clothing strips (flexible clothing) fastened on a support member to extend in the longitudinal direction thereof, or by saw tooth wire strips (metallic card clothing) arranged side by side and extending in transverse direction of the flat.

36 Claims, 12 Drawing Sheets

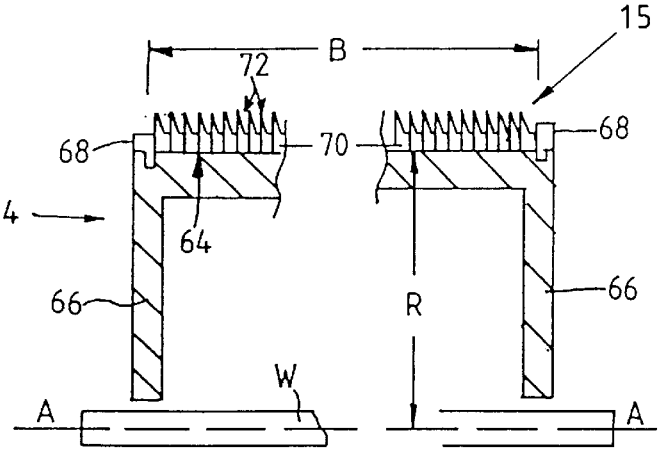
Fig. 3
Fig. 4
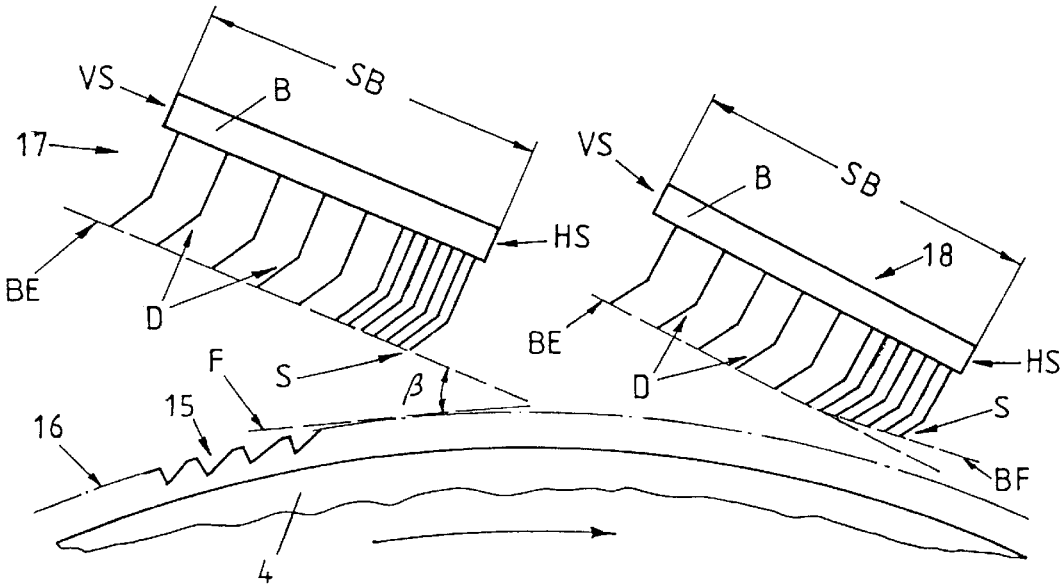

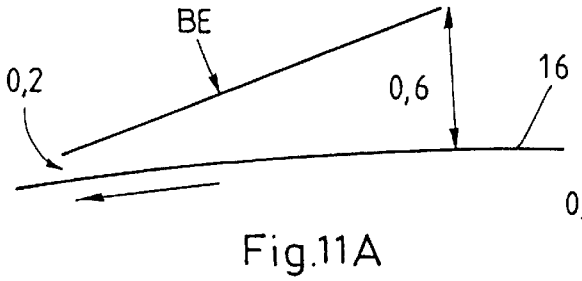
Fig.11A
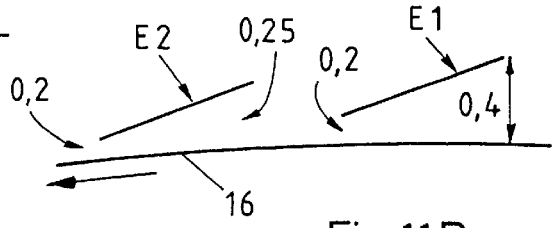
Fig.11B
Fig.12
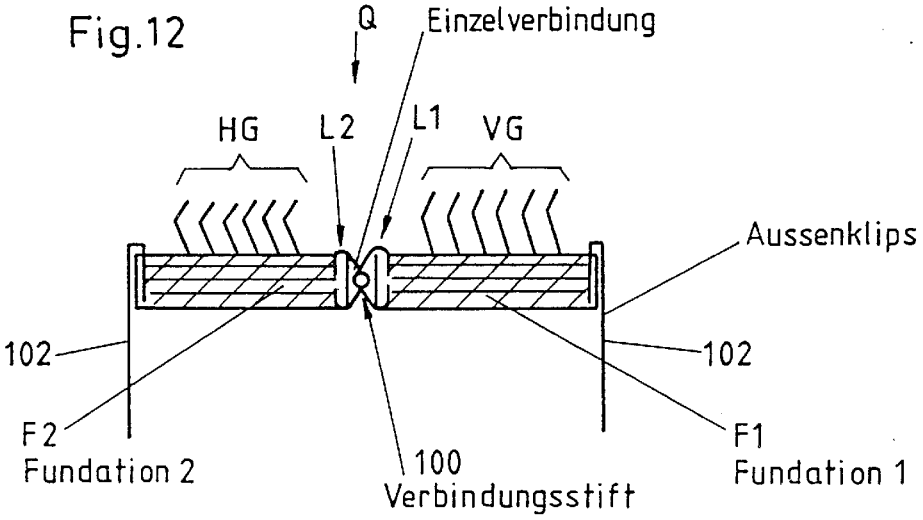
Fig.13
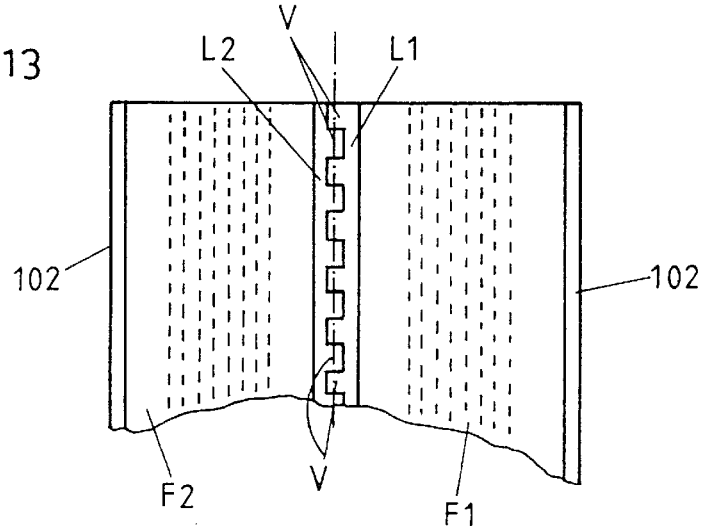

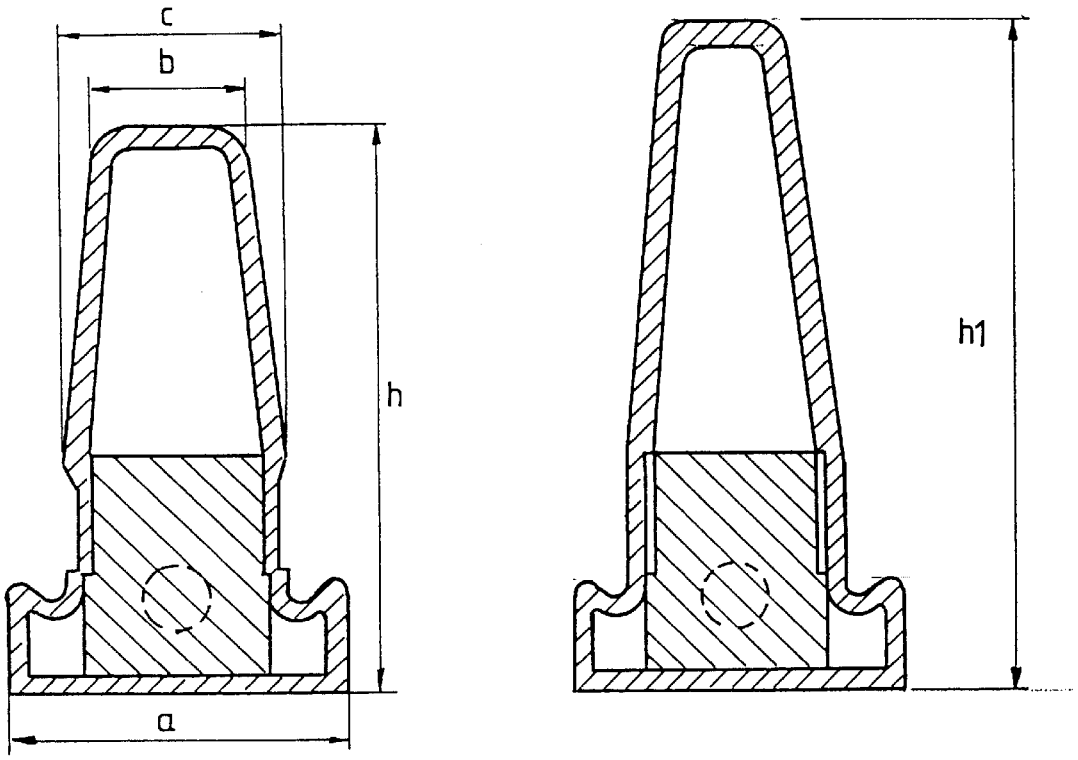
Fig.20
Fig.21
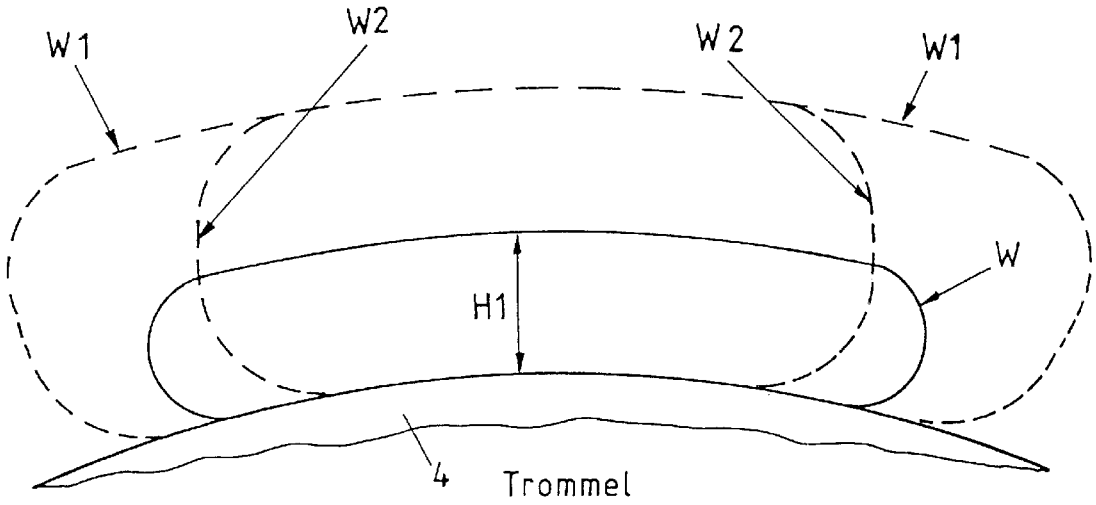

CARD FLAT FOR A TEXTILE CARD MACHINE

BACKGROUND OF THE INVENTION

The present invention concerns in particular the mounting of clothing on flats of a card.

1. Previous Patent Application/Field of Application

The present invention is particularly, but not exclusively, aimed at applications in combination with a "small card", i.e. a card the main drum of which has a relatively small diameter. An example of a card of such type is described in patent application EP 98 810088.9 filed Feb. 19, 1998 (Equivalent—U.S. Ser. No. 09/028,425 dated Feb. 24, 1998). The contents of said previous applications are herewith incorporated into the present description.

The present invention also presents particular advantages in connection with a "wide card", i.e. a card the working width of which exceeds 1000 mm. A card of such type also is described in the preceding applications, other wide cards also being known, e.g. the "Super Card" which was offered by the Schubert & Salzer Company. A flat for a machine of this type is shown in U.S. Pat. No. 4,827,573.

Furthermore use of the present invention in conventional cards and roller cards is not excluded even if the present invention was not conceived specifically for such applications. The application in conventional cards comprises the application in so-called fixed flat cards equipped e.g. with fixed flats according to EP-B-431 482.

2. State of the Art

Basic studies concerning the mounting of clothing on revolving flat cards have been undertaken by the Institut fur Textil- und Verfahrenstechnik Denkendorf (Institute for Textile and Process Engineering at Denkendorf) as can be seen especially from the literature cited in the following:

(i) Melliand Textilberichte, October 1885, pages 707 ff., and (ii) textil praxis international, September 1994, pages 551 ff.

Furthermore, since 1954 it is known (DE-Gbm-16 94 956) that formation of "carding lines" by subdividing the clothing points into groups can present advantages under certain conditions. The latter proposal is not widely used in practice, or rather has been overlooked in the meantime in further development of high performance cards.

Also the proposal described in the DE-Gbm 1733250 of using a flat the clothing of which is formed "by wire points of different diameter wires" has become obsolete.

SUMMARY OF THE INVENTION

The present invention provides a flat with a clothing for use in a card, the clothing points being subdivided into groups.

In a first aspect, a flat according to the present invention is characterized in that each group comprises points which in the card can be arranged in such a manner that a heel, or a heel zone respectively (with or without heel grinding finish), is formed.

In a second aspect, a flat according to the present invention is characterized in that the groups each can contain, or form respectively, a respective clothing plane.

In a third aspect, a flat according to the present invention is characterized in that at least two clothing strips extending in the longitudinal direction of the flat and arranged side by side are fastened to an elongated support member in which arrangement each strip forms one of said groups of points.

In a fourth aspect, a flat according to the present invention is characterized in that the length of the area provided with clothing exceeds 1000 mm (e.g. 1200 to 1500 mm).

The point groups, or the strips respectively, can present different clothing parameters, e.g. different wire lengths, wire diameters , clothing point densities, arrangement patterns, thickness of the base or foundation.

The point groups (according to the first, second, third or fourth aspect) preferentially are fastened to a common support member which presents sufficient structural stiffness for permitting precise settings of the clothing points relative to the clothing provided on the main drum across the full working width.

The terms "heel zone" and "heel" and "clothing plane" should be known to the person skilled in the art, but they are explained in more detail in the following with reference to the FIGS. 1 through 4 for a current conventional flat clothing.

In the FIG. 1, a revolving flat card 1 known as such, e.g. the card C50 produced by the present assignee, is shown schematically. The fibre material is fed in the form of opened and cleaned flocks into the feed chute 2, is taken over by a licker-in 3 (also called taker-in) as a lap, is transferred to a main drum 4 (also called main cylinder) and is opened and cleaned further by a set of revolving flats (in a revolving flat assembly 5). Fibres from the fibre web present on the main drum 4 then are taken over by a doffer roll 7 and in a delivery arrangement 8 comprising an arrangement of various rolls are formed into a card sliver 9. This card sliver 9 then is deposited by a coiler arrangement 100 into a transporting can 110.

In the FIG. 3, a portion of the main drum 4 is shown with its cylindrical surface 64 and lateral disks 66. The surface 64 is provided with a clothing 15, which in the example shown is provided in the form of a wire 70 with a saw tooth profile 72. The saw tooth wire 70 is "wound" onto the main drum 4, i.e. tightly adjoining windings are placed between the lateral flanges 68, in such a manner that a "working area" studded with clothing points is formed. The axial extent of this working surface can be referred to as the "working width". On the working area, processing is to be performed as uniformly as possible, i.e. the processing of fibres. The clothing points all should be located in an imagined cylindrical surface which can be referred to as the envelope surface of the main drum 4.

The set of revolving flats comprises revolving flats 13 which are not shown individually in the FIG. 1, but which are discussed in more detail in the following. Each flat 13 is of elongated shape and is provided with a clothing which co-operates with the clothing 15 on the main drum 4. The length of the flat is chosen such that it extends across the full working width AB (FIG. 3). The length of the area of the flat 13 provided with clothing corresponds to the working width AB. The flats 13 each are fastened to a chain or a belt 5 (e.g. according to EP-A-753 610) and move along a closed loop "flat path" (via deflecting rolls 6) in the same direction as or opposite to, the direction of rotation of the main drum 4 in which arrangement in a "forward movement" (from the engaging point E to a disengagement point A) the actual carding work is performed, and in the "return movement" the flats are cleaned at a cleaning point (not shown).

The essential elements of the revolving flat assembly thus are the individual flats 13, each flat comprising a support portion and a clothing strip. The support portion is to show the required strength and structural stiffness in such a manner that precise gap widths between the flat clothing and the main drum clothing 15 can be maintained at the centre of the working width as well as at the drum disks. A suitable design of the support portion is shown in the FIGS. 8 through 11 of U.S. Pat. No. 5,542,154. Many suitable alternative design examples are known, and certain further developments will be discussed with reference to the FIGS. 20 and 21, the present invention not being restricted to the application in connection with said further developments in any way. The support portion of course also must present surfaces to which a clothing strip can be fastened.

In the FIG. 2 a so-called flexible arc 120 of a card is shown with revolving flats 13 (two of them only being shown) moving thereon. On this flexible arc 120 setting elements 115 are provided such that the distance between the revolving flats 13 and the main drum surface, the so-called carding distance or working distance, can be set by adapting the curvature of the flexible arc 120. The design of such setting elements acting on the flexible arc are known e.g. from the German utility DE-U-93 13 633. In the case illustrated the setting elements are adjustable not merely manually but also are adjustable automatically by means an actuating system, e.g. small setting motors 117. For the actuating system a control arrangement 116 is provided. Details of this arrangement are described in EP-A-787 841 and thus are not repeated here.

Each flat 13 comprises a sliding portion which in the working position of the flat is guided along the flexible arc 120 and on its return movement is guided on a guide rail (not shown). The sliding portion is provided with two protrusions (visible in the FIG. 2 but not indicated particularly) which engage a sliding surface on the flexible arc, together forming a "contacting surface" for the flat. The contacting surface is arranged at right angles relative to a plane which contains the rotational axis of the main drum and divides the contacting surface into two portions of the same size. This contacting surface will be mentioned in the following as it represents a "reference surface" in the layout of a flat. The contacting surface together with the sliding surface of the flexible arc essentially determine the width of the working gap (the working distance) between the flat clothing and the main drum clothing. The structure of the flat and its shape stability determine the precision to which the working gap can be set as well as the "geometry" of the working gap.

The illustration shown in the FIG. 4 serves for explaining the terms "clothing plane" and "heel". A portion of the main drum 4 is shown schematically with its saw tooth wire clothing 15 which presents an envelope surface 16. Furthermore, two conventional flat clothing strips 17 and 18 are shown. The support portion of the flats supporting these strips are not shown in the FIG. 4 as they are not of importance for the following explanation.

The clothing strips 17 or 18 of a flat can contain flexible (semi-rigid) clothing or a metallic clothing (compare the handbook "A Practical Guide to opening and Carding" by W. Klein, p.49, editor: The Textile Institute, Manchester). Flexible clothing is provided with points formed by "wires" D in which arrangement the wires are inserted in a "base" B (also called foundation) in such a manner that a strip is formed which can be fastened to the support portion. The wires D are provided with a "knee" as shown in the handbook and (schematically) in the FIG. 4, the knee not being indicated in all of the following schematic Figures as it is not relevant in the context of the present invention. From the cited article in textil praxis international, it will be clear that the illustration shown in the FIG. 4 is much simplified. It contains, however, all the elements which are relevant for the explanation of the term "heel".

The base B is of a certain "width" which depends on the width of the support portion. Within this base width a narrow "set width" SB is studded with wires (compare the article in Melliand Textilberichte mentioned above). The base width currently chosen is about 35 mm, the set width about 22 mm. The wire material itself is standardised (DIN/ISO 4105, edition 1984). Regrettably, it must be born in mind that the width of the flat, or the base width respectively, extends transversely relative to the working width AB of the card (FIG. 3). After the base has been provided with wires, the free ends of the wires (the "points") are ground in such a manner that the points are arranged in a predetermined plane (the plane BE). This plane is the "clothing plane". The plane BE encloses an angle β with an imagined plane F, which plane F represents a tangent plane intersecting the envelope surface at a point corresponding to the point S mentioned below.

The rotational direction of the main drum 4 is indicated in the FIG. 4 with an arrow. The direction of movement of the clothing strips is not indicated being irrelevant in the present context—no matter whether the clothing strips 17, 18 move in the same direction as the clothing points of the main drum (cocurrent movement) or in the opposite direction, owing to the much higher velocity of the main drum clothing, a "front side" and a "back side" can be determined on each strip 17, 18.

According to conventional practice of mounting clothing, each strip 17, 18 is arranged in its working position facing the main drum clothing 15 in such a manner that the (working) distance of the clothing points on the front side of the strip is wider than the corresponding distance at the back side of the strip. Between each flat strip 17, 18 and the main drum clothing 15 thus a "narrowest point" S results which normally is situated at the back side of the strip. The clothing zone in the vicinity of this narrowest point S in this description is referred to as the "heel", or the "heel zone" respectively. The heel preferentially is formed in a margin zone of the strip the details of which arrangement depend on the above mentioned manner in which the flat is guided.

In the FIG. 4 also two further characteristics are shown schematically which frequently, (but not necessarily) distinguish the heel zone from the flat clothing zone "preceding it", namely:

(i) the density of the clothing, or of the points respectively, in the heel zone in some cases is chosen higher than the point density in the front zone of the strip (which is the case for the two strips 17, 18 shown in the FIG. 4) The actual values of the point density should be chosen as a function of the main drum clothing characteristics, the rotational speed of the main drum and of the material to be processed (compare the above mentioned article in Melliand Textilberichte), (ii) the heel zone in most cases is provided with a so-called "heelgrinding" finish in which the clothing plane BF of the points in the heel zone is arranged at an angle with respect to the above mentioned clothing plane BE of the points in the front zone (which applies only to the strip 18 shown in the FIG. 4).

Here and in DE-Gbm-16 94 956 it is postulated that the carding action at least for certain types of fibre material is influenced by the number of carding lines, the Gbm reference showing three carding lines per flat. A flat clothing according to the first aspect of the present invention differs, however, from the clothing according to DE-Gbm-16 94 956 in that the groups of points according to the utility model each lack a heel zone. A flat clothing according to the fourth aspect of the present invention differs from the state of the art (particularly from the DE-Gbm-16 94 956) in that each group of points presents a clothed surface having a length greater than 1000 mm (e.g. 1200 to 1500 mm).The specific advantages of the present invention in connection with the wide card (i.e. with the long flat) will be discussed in the following with reference to the FIGS. 20 and 21.

The different groups of points of a flat according to the present invention each can present a clothing plane (or needling plane). These clothing planes can present similar, or different, geometrical relations to the above mentioned contacting surface. The clothing planes can e.g.:

both have points in respective planes each of which extends parallel to the contacting surface, both have points in respective planes each of which is arranged at an angle (at the same/different angles) with respect to the contacting surface, or one of the clothing planes can be arranged parallel to, and the other one at an angle with respect to, the contacting surface.

In the preferred application of a common support member for a plurality of groups of points, special measures are to be taken due to the curvature of the envelope surface 16, in order to form a separate heel for each group of points. For this purpose, the wires of the different groups can be of different lengths. The support portion, or the base respectively, can be modified so that wires of the same length in different groups are differently presented to the main drum clothing points while in the working position of the flat. Examples of such new modified designs will be discussed in more detail in the following with reference to the further Figures.

DE-Gbm-17 33 250, as well as the article mentioned above in "textil praxis international", also show, however, that other clothing parameters can play an important role in the carding process, particularly:

the wire thickness, the point arrangement pattern.

The present invention does not state new findings concerning the point arrangement pattern which thus can be disregarded in the following description, any advantageous point pattern arrangement being applicable.

The above mentioned article in "textil praxis international" indicates that coarser wires under certain operating conditions entail disadvantages ("coarser" in this context indicates a wire of a larger diameter which in the DIN/ISO terminology corresponds to a lower "wire number"). In particular the take-up capacity of a clothing is reduced if the wire thickness is increased while the point density is maintained constant, which under certain circumstances can prove disadvantageous (compare the above mentioned article in Melliand Textilberichte). On the other hand, the life time of finer wires generally (under given operating conditions) is shorter.

It thus can prove advantageous to apply a plurality of wire thicknesses on a flat, i.e. to adapt the wire thickness to the "task" particularly if coarser wires are used in the "front" zone of the clothing strip, two reasons favouring this arrangement, namely:

the freshly supplied (not yet fully opened) fibre material first meets the front wires which thus are subject to the highest load.

Application of coarser wires in the front zone exerts a lesser influence on the achievable technological result than a corresponding change in the heel zone.

In combination with the already described concept of groups of points the application of different wire thicknesses can be made use of in two manners:

(i) Each group can be provided with a different wire thickness, and (ii) Within each group different wire thicknesses can be provided.

BRIEF DESCRIPTION OF THE FIGURES

Embodiments of the present invention are discussed in more detail in the following with reference to the drawings in the Figures, in which FIG. 3 is a schematic view of a portion of the main drum of the card according to the FIG. 1 including its wiring (clothing); this Figure mainly serves for explaining the term "working width", FIG. 4 is a schematic view of conventional arrangements of flat clothing points facing the points of the main drum clothing.

FIG. 11 shows two diagrams (FIGS. 11A and 11B) for explaining the narrower working distances which can be realised using the present invention, FIG. 12 is a cross-section of a further variant for realising the group concept according to the present invention, FIG. 13 is a view in the direction of the arrow Q in the FIG. 12, FIG. 20 shows schematically two flat profiles for explaining the significance of the flat length, and of the working width respectively, and FIG. 21 shows schematically various lines of action of a traction means (drive belt) in a revolving flat assembly.

DETAILED DESCRIPTION

FIGS. 1 through 4 have been explained already in the introduction of the present description and thus are not described further here.

Figure 1:
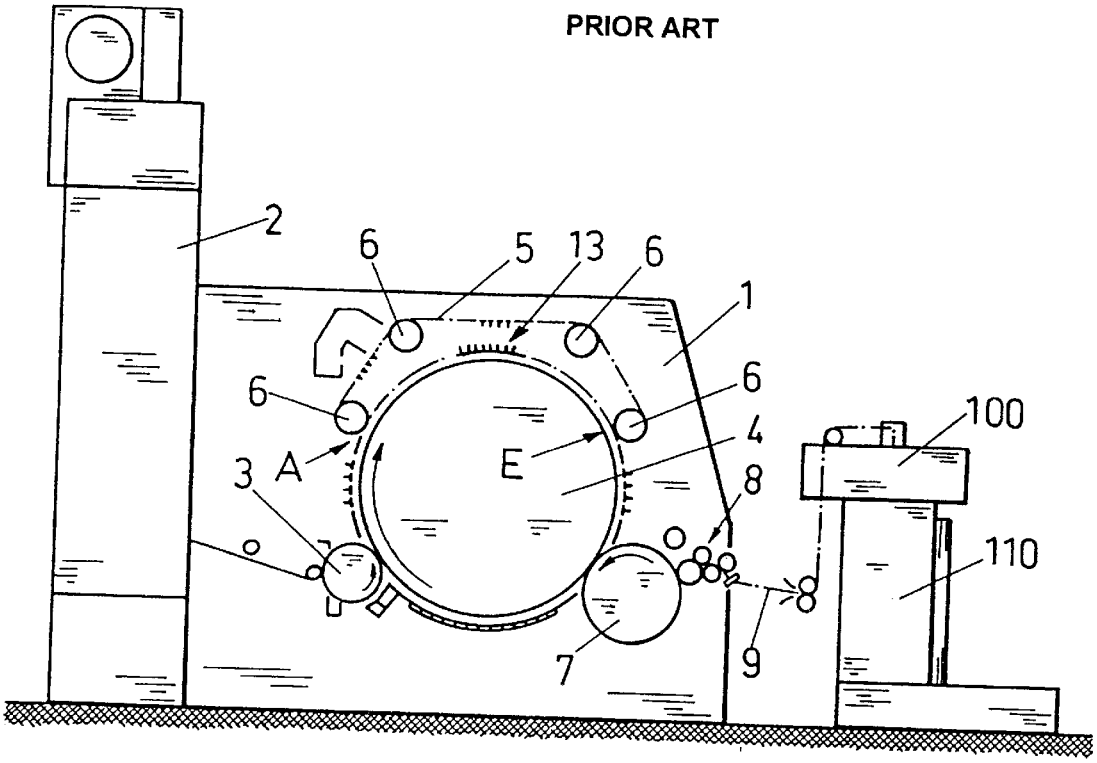
Fig.1 PRIOR ART
FIG. 1 is a copy of FIG. 1 of EP-A-753 610.
Figure 2:
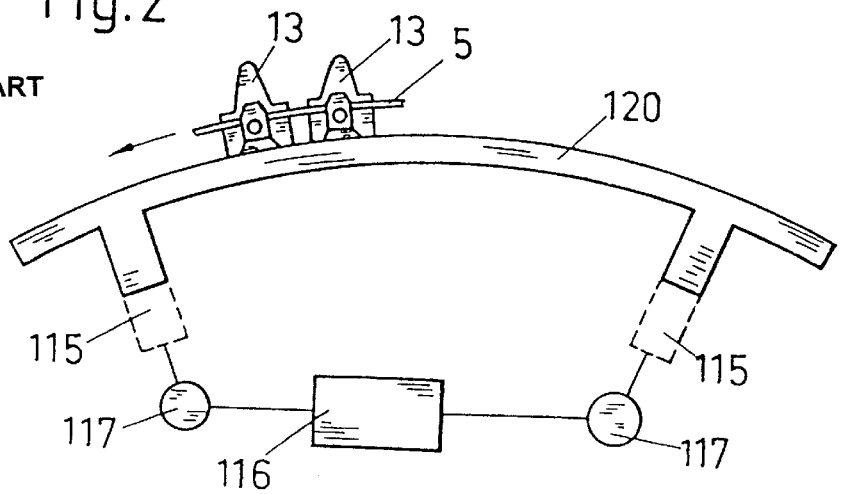
Fig.2 PRIOR ART
FIG. 2 is a copy of FIG. 2 of EP-A-753 610.
Figure 5:
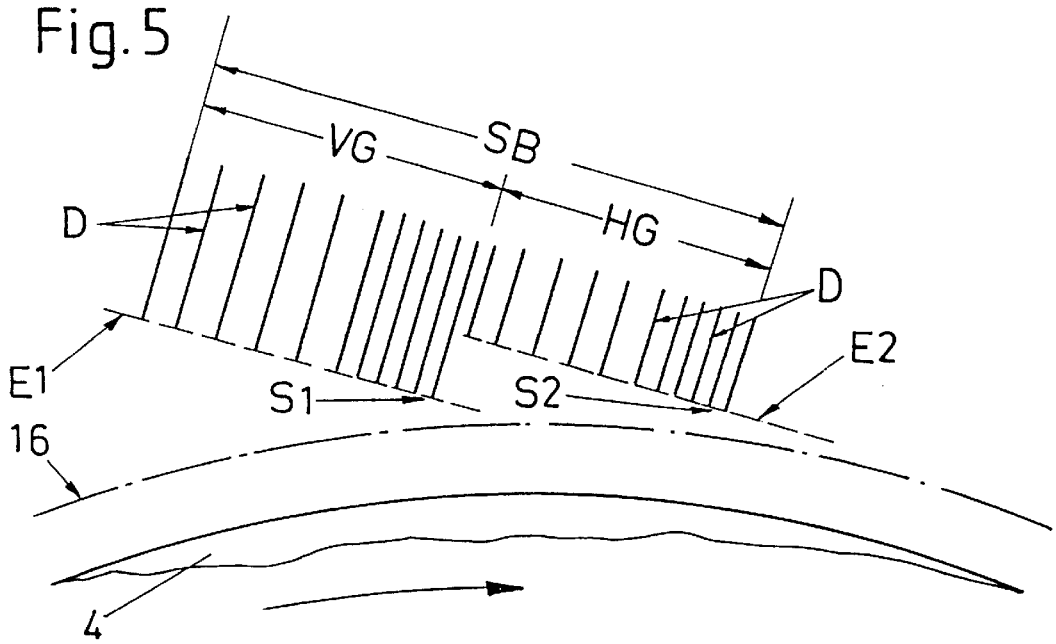
FIG. 5 is a schematic view of two groups of points of a single flat in its working position facing the main drum, the flat itself not being indicated in this illustration.

In the FIG. 5 the view of the main drum 4 corresponds to the one in the FIG. 4. The clothing of a single flat also is shown schematically (the flat itself not being shown) in the FIG. 5 with a set width SB of the whole clothing strip. The points of this strip are subdivided into two groups (a front group VG and a back group HG) the terms "front" and "back" corresponding to the explanations referring to the FIG. 4.

The arrangement of the wires in the FIG. 5 yields a "clothing plane" E1 for the front group of points and a second clothing plane E2 for the back group of points, i.e. the points of the front group all are arranged in the imagined plane E1 and the ones of the back group all are arranged in the imagined plane E2. These planes are arranged in such a manner that each group VG, and HG respectively, present their own narrowest gap S1, and S2 respectively (or, expressed in other words, the groups VG, and HG respectively, present their own heel).

Figure 6:
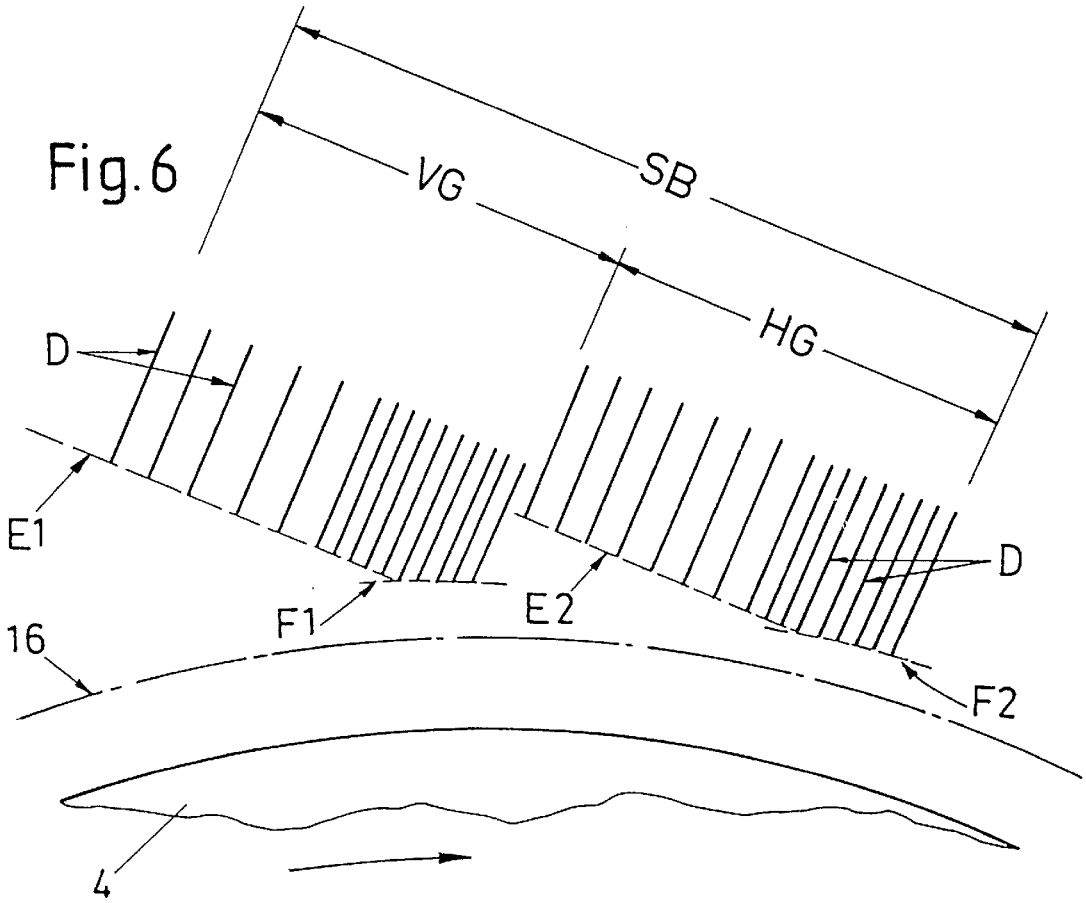
FIG. 6 is a similar view of a modified embodiment.

The arrangement according to the FIG. 6 differs from the arrangement according to the FIG. 5 in so far as the points in each heel zone are provided with a "heel grinding" finish. Thus for each group VG, HG a respective clothing plane E1, and E2 respectively, results for the front group of points (similar to the FIG. 5) and a respective heel plane F1, and F2 respectively, which angle off from the clothing planes of the front group of points. The arrangement according to the FIG. 6 in principle can be "achieved" by transforming an arrangement according to the FIG. 5 in such a manner that the points in each heel zone are ground additionally in order to form the angled-off "planes" F1, F2. In the FIG. 6 also a preferred variant of the heel grinding finish is shown in which the points in the heel zone are arranged not actually in a "plane" but in an imagined curved surface F1, F2 the curvature of which is concentric with the envelope surface 16.

The arrangement according to the FIGS. 5 and 6 differ from the state of the art according to DE-Gbm-16 94 956 in so far as the two heel zones are provided. The utility model also provides "gaps" between the groups of points in which arrangement air turbulences in the gaps should have contributed to the success of the solution then proposed. In the FIGS. 5 and 6 no special "gaps" are provided between the groups VG and HG but possibly a similar effect is achieved in that the point density, or the clothing density, in the heel zone of front group VG each is chosen higher than the one in the adjoining zone of the back group HG (in the Figures this is indicated schematically). Of course also "gaps" according to the utility model could be applied.

It is unlikely that air turbulences as such in such gaps could create an improvement of the carding action. It is known, however, that a "web bridge" (i.e. a coherent array of fibres) forms in the gap between neighbouring flats of a conventional revolving flat assembly and "bridges" this gap. The formation of such bridges might be assisted by air turbulence. The fibre web (the fibre or web bridge) acts as a filter for dust and trash which is taken up by the web and is eliminated with the web bridge as the gaps between the flats are cleaned—this effect contributes substantially to the cleaning efficiency. The flats according to the present invention also can be arranged in the revolving flat assembly in such a manner that web bridges (similar to the web bridges between the flats) can form between adjacent flats. However, it is now also possible to arrange the point groups in such a manner relative to each other, that web bridges (similar to web bridges between the flats) are formed between the groups. It thus is possible to double also the number of web bridges (as well as the number of carding edges, or carding lines respectively). The overall dust and trash retaining capacity of the web bridges thus is increased noticeably because the new web bridges can be markedly shorter (in the direction of fibre transport) than the ones in a conventional revolving flat assembly. For favouring the formation of web bridges also gaps can be left free of clothing between neighbouring groups as will be explained in the following with reference to various Figures.

Figure 7:
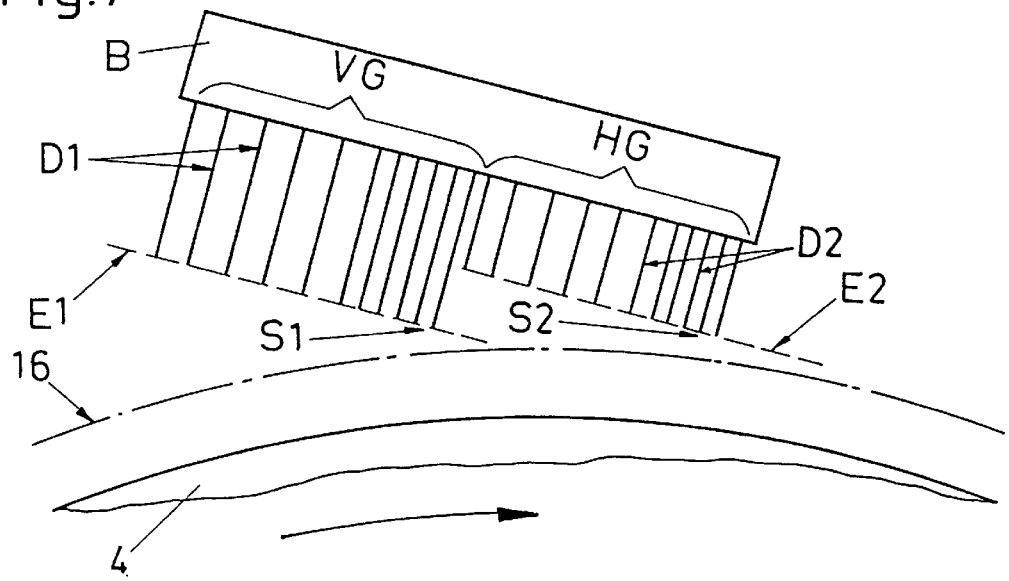
FIG. 7 is a first embodiment of a flat for realising the principle according to FIG. 5 or FIG. 6.

In the FIGS. 7, 8 and 9 design measures are shown which are suitable to realise the clothing concepts according to the FIGS. 5 and 6 in practice. For the sake of simplicity in the various Figures only clothings are shown without heel grinding finish—from the previous discussion it will be clear, however, that the flat embodiments shown can be used with clothings with or without heel grinding finish.

The embodiment according to the FIG. 7 comprises a conventional base B (of uniform thickness). The groups VG and HG consist of wires D1 and D2 of different length the wires D1 of the front group being somewhat longer than the wires D2 of the back group. For a given wire thickness the wires D1 of the front group are therefore more elastic than those of the backgroup, which is not desirable in all cases. A first solution of the problem arising therefrom is shown in the FIG. 8A according to which the base forms a "step" 20 (corresponding to the step between the two clothing planes E1, E2) owing to which the same wires D1 and D2 (compare the FIG. 7) present identical free lengths L ("height of the wire) in which arrangement the required two clothing planes E1 and E2 result. The exaggerated illustration of the heel grinding finish F1 and 2 does not change the fact that the free wire lengths are about equal.

Figure 8A:
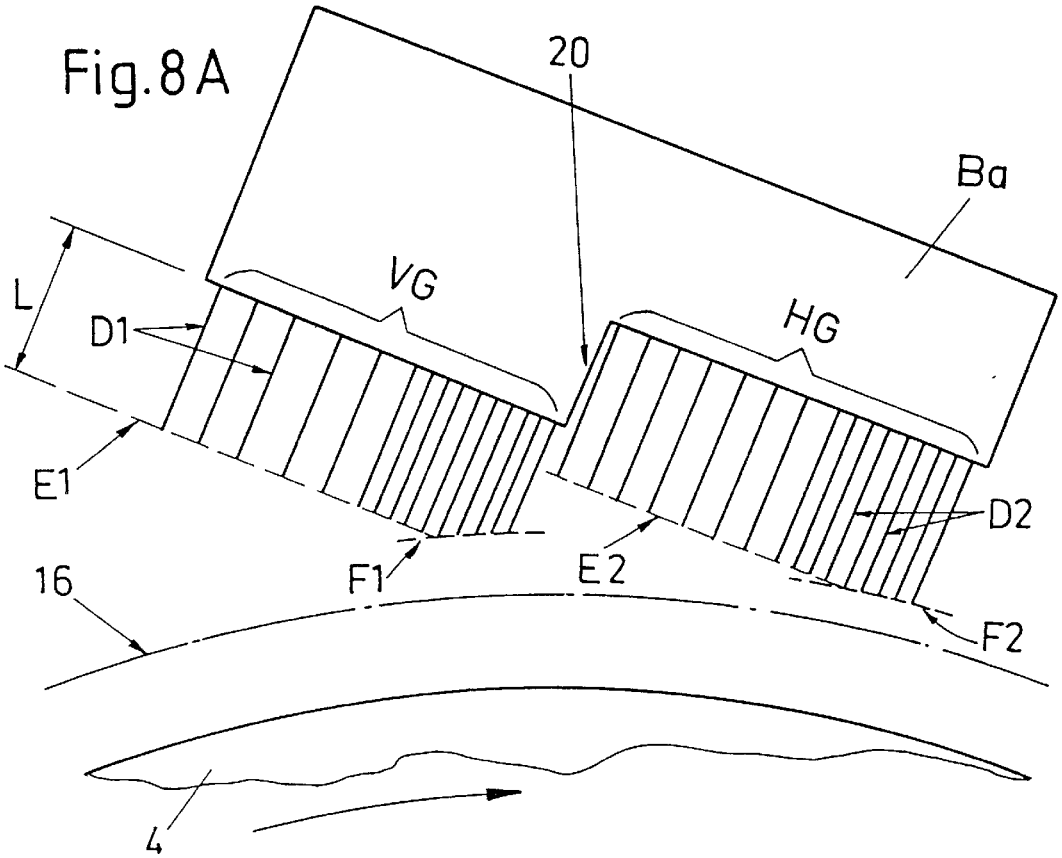
FIG. 8 shows in FIGS. 8A through 8C further embodiments for realising the principle according to FIG. 5 or FIG. 6.

The general arrangement according to the FIG. 8A also can be realised in other manners. If the wires of the front group are chosen actually longer than the wires D2 of the back group and the uniform wire height result has to be achieved by means of differences in the base thickness, this can be realised according to the FIG. 8B. Instead of a step provided in a single base, the modified proposal uses two base bodies B1 and B2 of different thickness which are to be arranged side by side on the support member portion (not shown). Thus two clothing strips result which can be formed separately. The long wires D1 extend through the whole thickness of the body B1. A third manner of realising the arrangement is shown in the FIG. 8C—the wire length is the same in both groups of points, and the step of the base 20 for the front group is formed by an extension 21, and the wire lead parts of the front group are embedded between the layer of the conventional base B and the extension 21. The extension 21 can be e.g. adhesively connected to the conventional base B.

Although no "gaps" have been shown between the groups it is possible to create a "web bridge" in the wider working gap adjoining the narrowest point of the front group.

The solutions according to the FIGS. 7 and 8 can be realised in combination with a conventional support portion of the flat. The support portion also can be adapted to permit a change in the "wire arrangement pattern" as will be explained in the following with reference to various illustrations of FIG. 7. (FIGS. 9A through 9D) in which for the sake of simplicity all illustrations in the FIG. 9 in principle are based on a known T-shaped cross-section of the support portion.

Figure 9A:
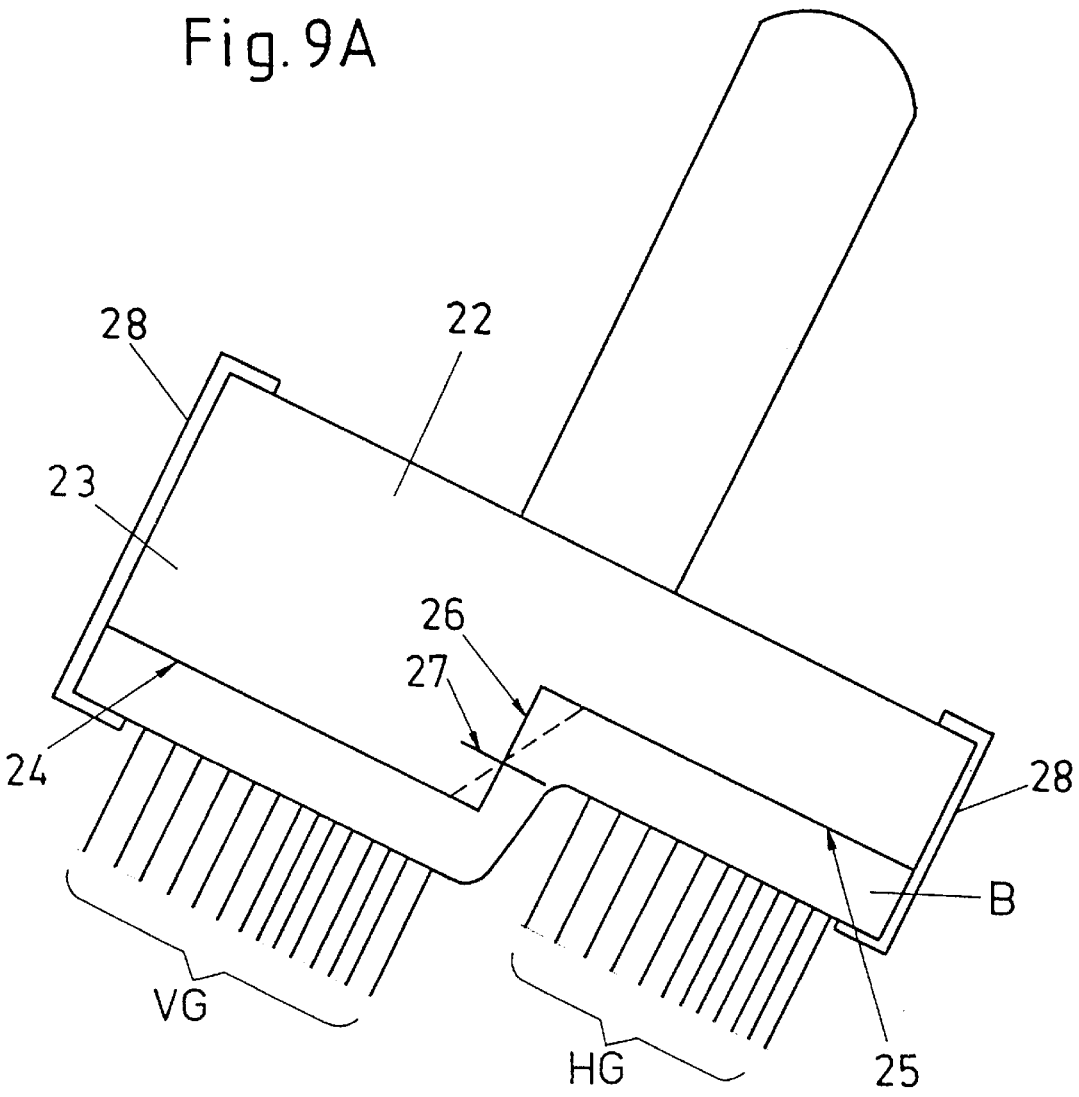
FIG. 9 shows in FIGS. 9A through 9D various embodiments requiring adaptation of the support portion of the flat also.

A first embodiment with a changed support portion is shown in the FIG. 9A. The new support portion 22 is provided with a protusion 23 in such a manner that the support zone presents two fastening surfaces 24, 25 with a step 26 in between. The base B can be of conventional design in which arrangement a gap (a distance) is left free between the front group VG and the back group HG. For manufacturing a clothing strip of this type, the "middle" wire rows of a conventional strip can simply be left out, i.e. the middle zone of the strip is not studded with wires. This gap is chosen such that a web bridge can form therein. The portions of the base studded with wires are fastened each to one of the fastening zones 24, 25 and the base portion left free between the wire groups VG and HG is fastened to the step 26 by means of a suitable fastening means (indicated schematically by a pin 27). The step 26, if desired, can be designed as a ramp (indicated with dashed lines) e.g. for rendering adhesive fastening of the strip feasible. The longitudinal edges of the clothing strip are fastened to the support portion by means of clips 28.

The variant according to the FIG. 9A can be obtained in that an additional element (not shown) with the protusion 23 is fastened to a conventional flat profile (e.g. adhesively). The added-on element in this arrangement is clamped between the base and the profile.

Figure 8B:
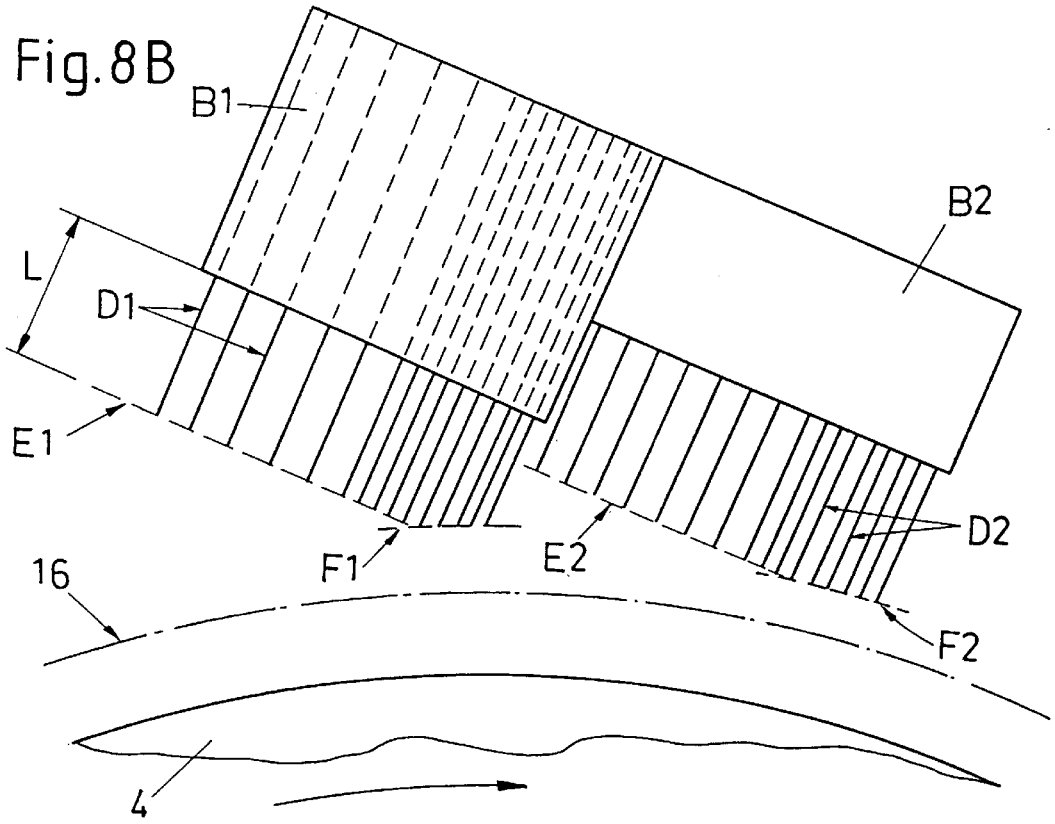
Figure 8C:
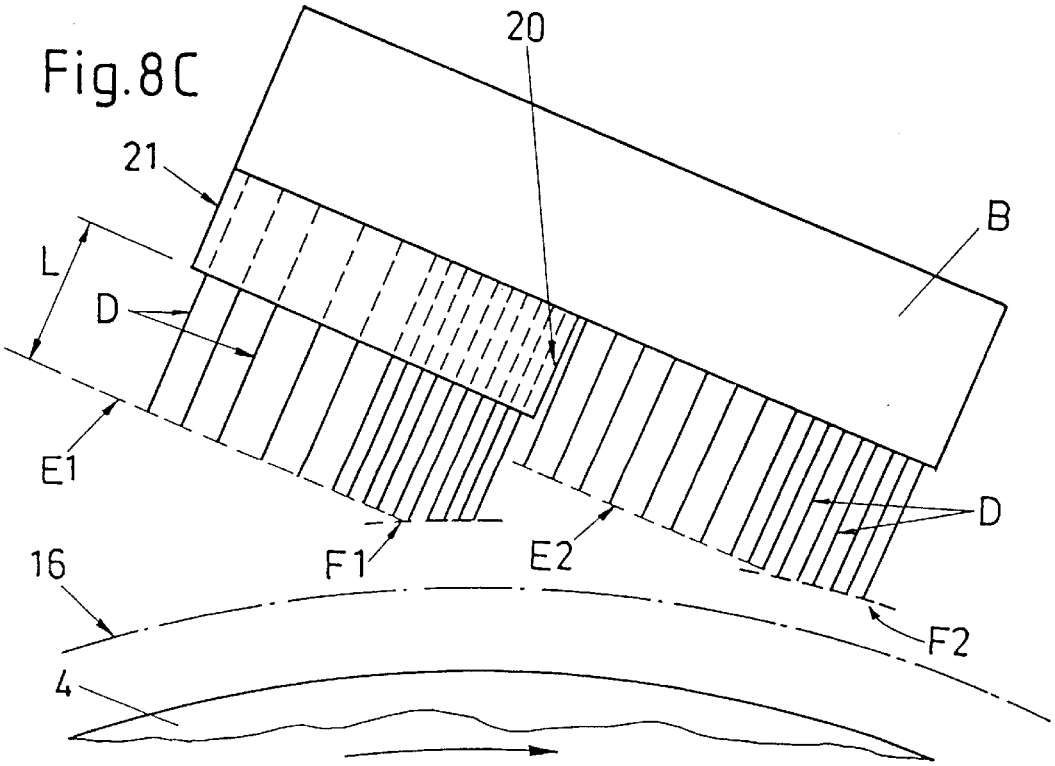
Figure 9B:
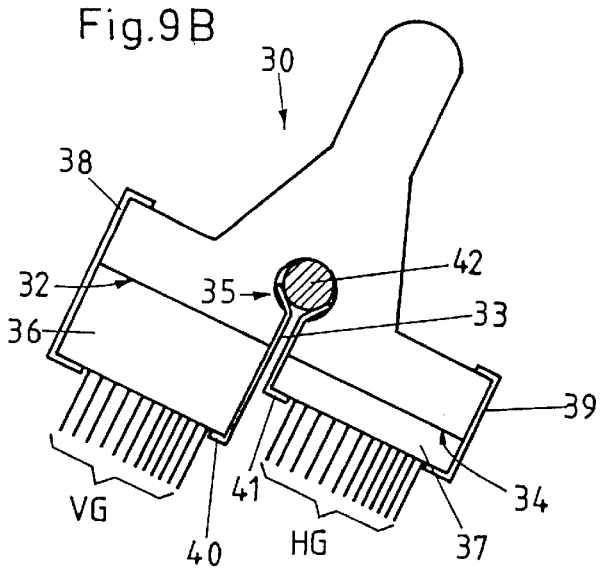

In the FIG. 9B a further variant is shown with a changed (non-conventional) support portion 30 conceived particularly for taking up two clothing strips (compare FIG. 8B). The support portion 30 is designed e.g. as a profile with two "take-up surfaces" 32, 34. A groove 33 is provided between the take-up surfaces 32, 34 in which arrangement this groove at its inner end is provided with a relatively large opening 35. To the two take-up surfaces 32, 34 a clothing strip each 36, 37 can be fastened by means of a pair of clips, one clip each 38, and 39 respectively, engaging the corresponding longitudinal edge of the flat, and a clip 40, and 41 respectively, being taken up in the groove 33,or in its opening 35 respectively. The two strips 36, 37 can be formed separately and thus can be of different thickness. A blocking element 42 (e.g. an elastic cable, a round wire or another wire shape) also can be taken up in the opening 35 (e.g. threaded therethrough) in order to prevent a bending back movement of the clip legs. The opening 35 shown is of circular cross-section but could be given another shape (polygonal, e.g. rectangular, triangular, etc.). Here also a distance (a gap) is provided between the front group and the back group of points.

Figure 9C:
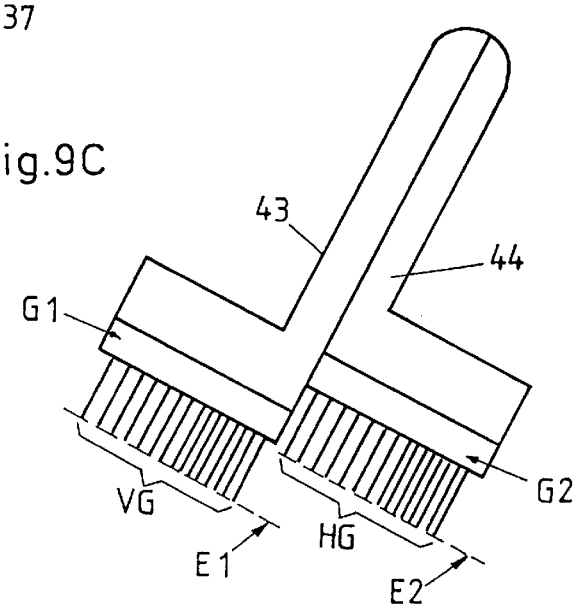

The basic principle of a further adaptation of the support portion of the flat is shown in the FIG. 9C. This principle calls for a support portion formed from two parts 43, 44 each of which corresponds to a group of points VG, HG which parts are fastened to each other using e.g. screws, rivets, adhesives. For the sake of simplicity the part 44 according to the FIG. 9C consists of an L-shaped rod and the part 43 of a ]-shaped rod. The rods are joined "back to back" in such a manner that they form a support member to which "identical" clothing strips G1, G2 are fastened. The two rod parts 43, 44 are offset against each other in such a manner that the two clothing planes E1, E2 to be provided are formed. A fastening system for the strips G1, G2 is not shown in the FIG. 9C; the strips could be adhesively fastened to a support member part each.

Figure 9D:
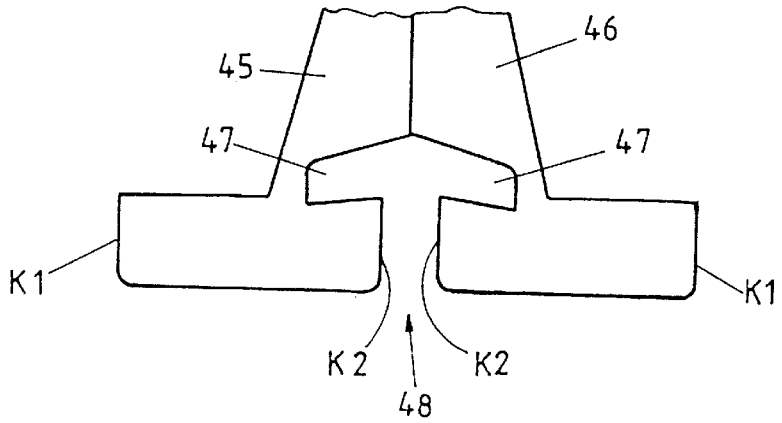

The same principle has been applied also in the embodiment according to the FIG. 9D namely for realising the fastening using clips (compare the FIG. 9B). Instead of a longitudinal groove between the two take-up surfaces (as shown for the embodiment according to the FIG. 9B) the joined lateral surfaces of the parts 45, 46 can be provided each with a longitudinal grove 47 which together form an opening as the parts 45, 46 are joined. The foot portions of the parts 45, 46 are not contacting each other but they leave open an access 48 passage to the opening. Each part 45, 46 thus is provided with two longitudinal edges K1, K2 which can co-operate with conventional clips in order to fasten clothing strips (not shown) of different thickness to the support portion.

In the FIG. 10 two flat arrangements according to the present invention are shown schematically the position of the rod profile also being visible in these Figures.

Figure 10A:
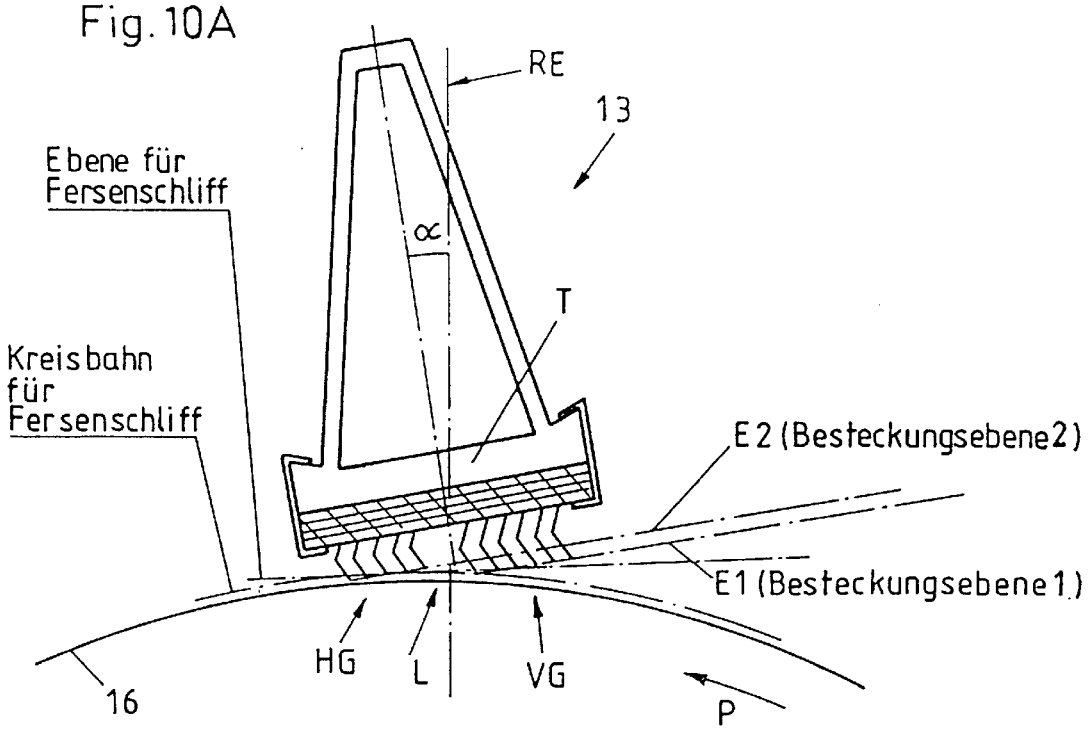
FIGS. 10A and 10B show schematically two flats each with a clothing according to the present invention.

In FIG. 10A shows the envelope surface 16 of the main drum (rotating in the direction P) as well as a flat 13 with a (clothing) support member T which can be a conventional support member. The points of the clothing on this flat are subdivided into two groups of points, of which the points of a front group VG are arranged in a clothing plane E1 and the points of the following group HG are arranged in the other clothing plane E2. Between the groups VG, HG a "gap" L remains free of clothing wires. As described above the clothing also can be formed without a gap L. Each of the clothing planes E1, E2 now presents a narrowest point facing the envelope surface 16 and the points at the, or at each of the, narrowest points can be provided with the heel grinding finish. For forming two groups the wires have different lengths. It is known from CH-C-177 219 to use clothing needles of different lengths; in that case, however, the needles of different length also were meant to perform different functions. The points according to the FIG. 10A in principle all perform the same function.

Figure 10B:
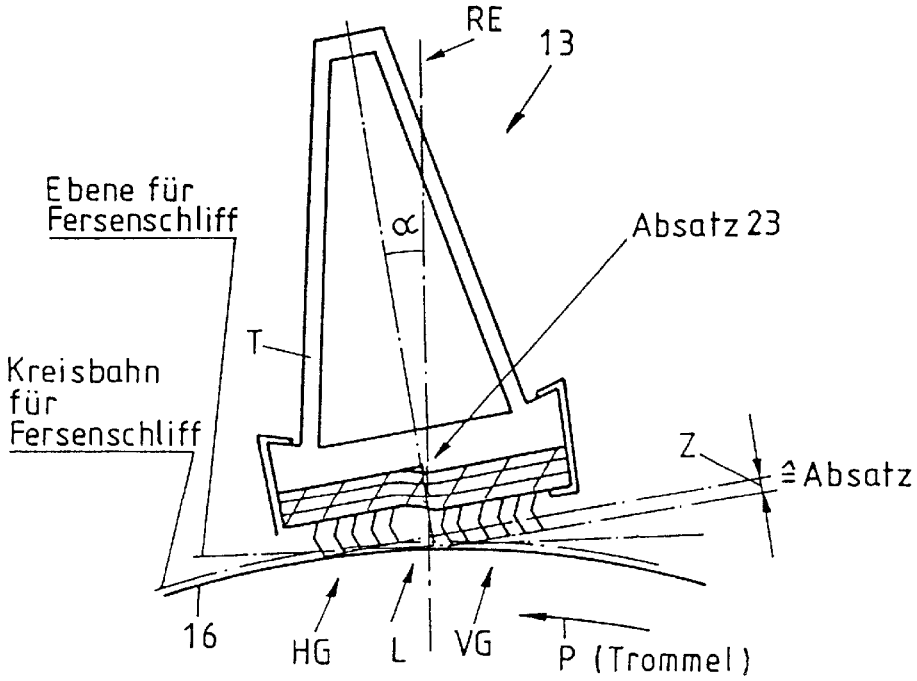

The flat 13 according to the FIG. 10B differs from the one according to the FIG. 10A in that the support portion T is provided with a protusion 23 (compare the FIG. 9A). Thus it is possible to form the two groups of points VG and HG with wires of the same length. The technological effect, however, is the same as with the arrangement according to the FIG. 10A.

In each of FIGS. 10A and 10B also the plane RE is shown which contains the rotational axis of the main drum 4 and which divides the contacting surface of the flat 13 into equal parts. The plane RE in this Figure is shown extending vertically, but its position in space actually changes continually while the flat moves from the engaging point E (FIG. 1) to the disengaging point A. The contacting surface (not shown) extends at right angles to the plane RE. The clothing planes E1, E2 in these Figures are shown arranged parallel and they each enclose an angle $\alpha$ with the contacting surface (not shown), the angle $\alpha$ being indicated in the FIGS. 10A and 10B between the plane RE and the symmetry plane of the support portion T. As indicated before this angle $\alpha$ can:

be zero for one or for both clothing planes E1, E2, be equal for both clothing planes E1, E2 (as shown in the FIGS. 10A and 10B), or be different for each one of the clothing planes E1, E2.

Also shown in the FIGS. 10A and 10B is a so-called circular path for the heel grinding finish and a plane for the heel grinding finish. These two possibilities indicate alternative solutions. In principle it is desirable to generate the heel grinding finish for each group of points based on the circular path (concentric with the main drum 4). This however, can result in the (ground) heel zone for the front group VG being noticeably shorter than the (ground) heel zone of the back group HG which could prove disadvantageous under certain circumstances. If this is the case, the heel grinding finish can be applied based on the plane indicated in the FIG. 10 which results in (ground) heel zones of approximately the same length for both groups of points.

It is possible to insert an additonal element (like the element 21, FIG. 8c) temporarily during the conventional grinding steps (grinding the height, the sides and the reverse face at the point) These steps are known to the man skilled in the art and therefore they are not further explained here. The element must be inserted under the point group which is to be shorter in the end product—in FIG. 10 A (e.g.) under the group with clothing plane 2. By this means, the points with clothing plane 2 are ground shorter by an amount corresponding to the thickness of the element. After the removal of the additional element the result is a clothing strip as shown in FIG. 10A.

The present invention generally permits narrower working gaps between the flat clothings and the main drum to be established as can be seen from the schematic illustration according to the FIG. 11. In the two diagrams shown in the FIGS. 11A and 11B the envelope surface of the main drum is indicated with 16. In the FIG. 11A the relations are shown if a conventional flat is used (compare the FIG. 4) in which arrangement the (only) clothing plane is indicated with BE. This clothing plane BE results in a working gap which at the narrowest point is 0.2 mm wide and at the front side is 0.6 mm wide. In the FIG. 11B the two clothing planes E1 and E2 are shown of a flat according to the present invention. Each of the planes E1 and E2 generates with respect to the envelope surface 16 a working gap of 0.2 mm width at the respective narrowest points in which arrangement the working gap width at the front side of the plane E1 is (e.g.) 0.4 mm wide and the one at the front side of the plane E2 is (e.g.) only 0.25 mm wide, i.e. on the average the points of the clothing according to the FIG. 11B are arranged noticeably closer to the envelope surface 16 than the points of the clothing according to the FIG. 11A.

The illustrations in the Figures are of purely exemplary nature, i.e. they do not correspond to reality in so far as the actual relations are hardly visible to the human eye. In practical applications the diameter of the main drum ranges from 700 mm to 1290 mm, the clothing set width of a flat on the other hand is about 20 mm to 25 mm. The working distance in the conventional heel zone normally is about 0.2 mm and at the front side of the clothing strip it is about 0.6 mm according to the invention. The clothing set width of a single group corresponds to about half the conventional clothing set width. The working distance in the heel zone can be maintained, but the one at the front-most wire rows of each group can be roughly halved compared to the working distance at the front side of a conventional flat. From the FIG. 11A an average distance of the clothing points from the envelope surface of the main drum results of about 0.4 mm. The arrangement according to the FIG. 11B, however, the flat width and the gap width at the narrowest point being kept constant, yields an average working distance of about 0.275 mm.

A further layout possibility for realising a clothing according to the present invention using two clothing strips is shown in the FIGS. 12 and 13.

The flat according to the FIGS. 12 and 13 comprises a first base (or foundation) F1 and a second base F2 each of which is provided with its own group of points or wires VG, and HG respectively, e.g. of different lengths. The two bases F1, F2 are provided with neighbouring rim zones each of which is taken up and held tight by a respective metal slat L1 and L2. The slats L1, L2 are provided with interengaging protrusions V. These protrusions V together form a "hinge" held together by a pin 100. Also rigid connections (without a hinge action) can be imagined. The outer rim portions of the bases can be fastened to the support portion (not shown) of the flat using conventional clips 102.

Figure 14:
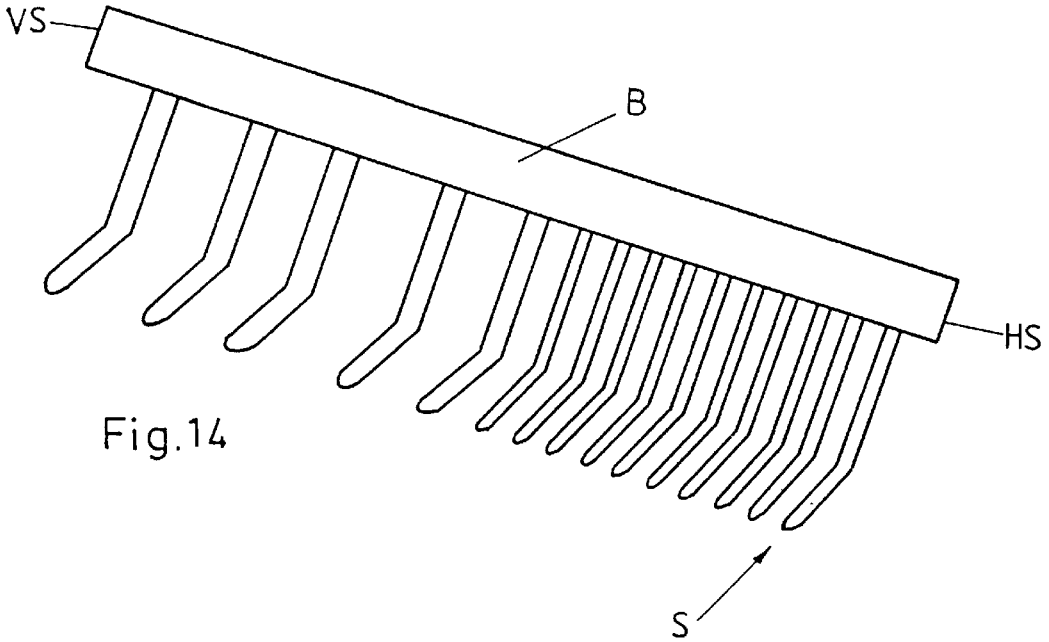
FIG. 14 shows a substantially conventional flat but provided with a clothing with points of different wire thickness.

With reference to the FIG. 7 it was stated that a higher elasticity of the wires of the front group is not always desirable. A further approach to solving this problem is shown in the FIG. 14 wherein two groups of points are formed in which arrangement the wire thickness in the front group is chosen greater than the wire thickness in the back group. This solution is shown in combination with a conventional flat (with a single clothing strip according to the FIG. 4).

Figure 15:
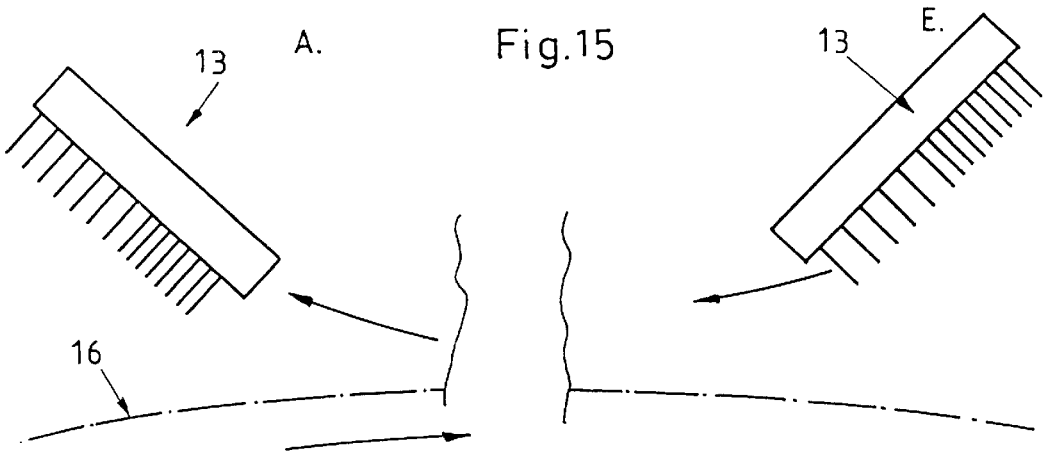
FIG. 15 is a schematic view of the engaging zone and of the disengaging zone of the revolving flat assembly of a card according to the FIG. 1 for a more detailed discussion of the flat according to FIG. 14.

In the FIG. 15 the engaging point E and the disengaging point A of conventional flats 13 is shown in relation to their working positions facing the main drum 4 with a direction of movement opposite to the direction of rotation of the main drum. At the engaging point E the front wires first meet the fibre web carried on the main drum; they protect the wires arranged more to the back as they take up the "impact" load caused by the first contact of the fibres on the flat clothing and (slightly) increase the degree of opening of the fibre web before the web is processed also by the wires arranged more to the back. At the disengaging point A the front-most wires are the first ones to leave their working position facing the main drum—up to this point they also help to protect the wires arranged to the back particularly as the flats here are processing "flocks" entered relatively recently. If the direction of the flat movement is reversed, this effect is intensified further as the degree of opening of the fibre material to be processed is still relatively low at the engaging point of the flats. Between the engaging point and the disengaging point the front wires thus in either case always perform a certain "preliminary work" for the wires arranged to the back, and thus it is advantageous in principle to choose the front wires somewhat coarser than the back wires also in an otherwise conventional flat.

Figure 16:
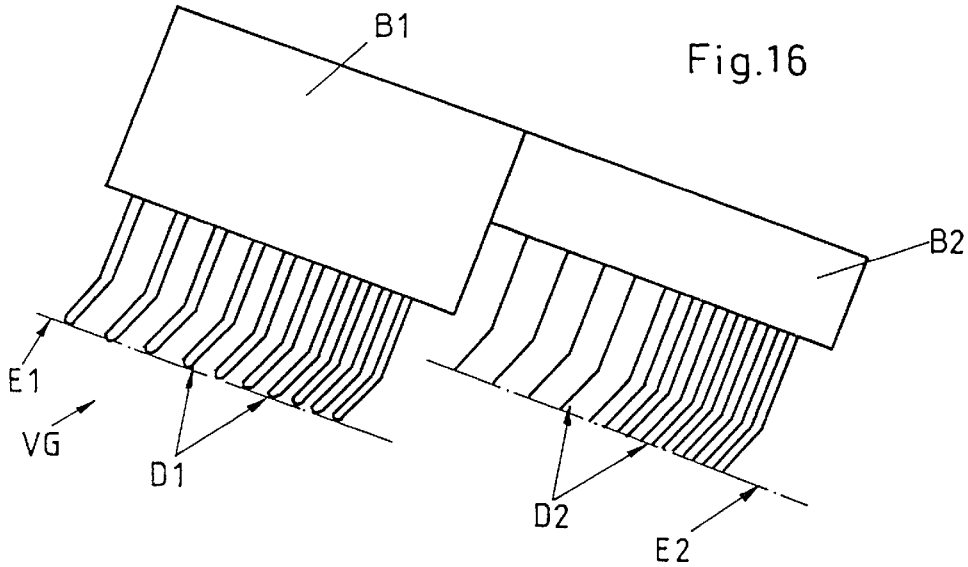
FIG. 16 is a schematic view of a first embodiment of a flat with a clothing according to the FIG. 5 or the FIG. 6 as well as also according to the FIG. 14.
Figure 17:
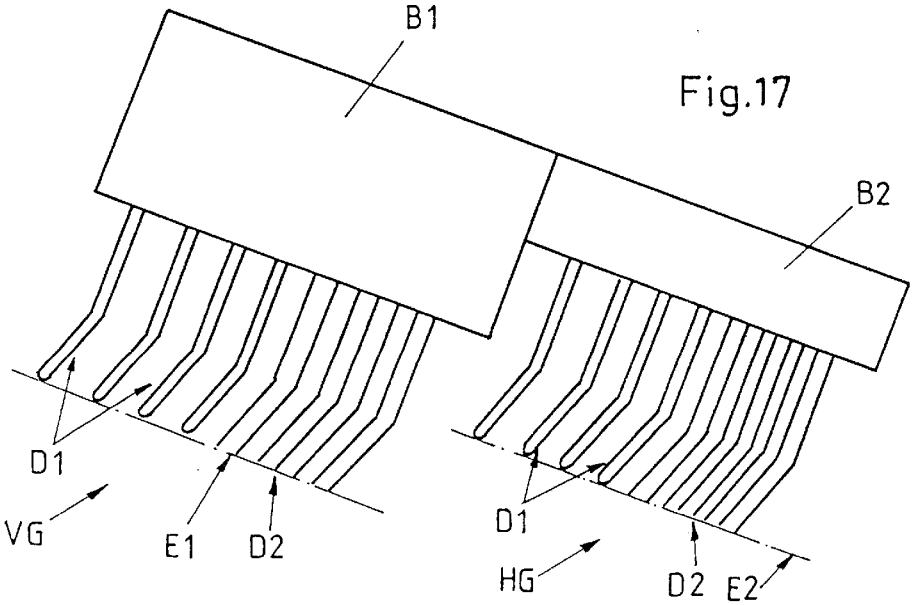
FIG. 17 is a schematic view of a second embodiment of the last-mentioned combination.

If now this idea is combined with the idea described before, basically two possibilities result:

(i) the front group VG is made up completely from wires D1 of a lower number (larger diameter) than the wires D2 of the back group HG (FIG. 16), or (ii) the back zones (heel zones) of both groups VG, HG consist of wires D2 of the same (fine) thickness, or number respectively, whereas the other (preceding) zones each consist of wires D1 of a lower number (larger diameter) (FIG. 17).

It obviously is not necessary that the wire thickness in one heel zone of one group be equal to the one in the other heel zone. On the other hand it will prove increasingly complex to apply many wire thicknesses on one single flat and such complexity normally will not be worth while. In the layout of a flat with different wire thicknesses the difference between the finer and the coarser wire clothing preferentially should be at least two wire numbers but preferentially not more than six wire numbers.

Figure 18:
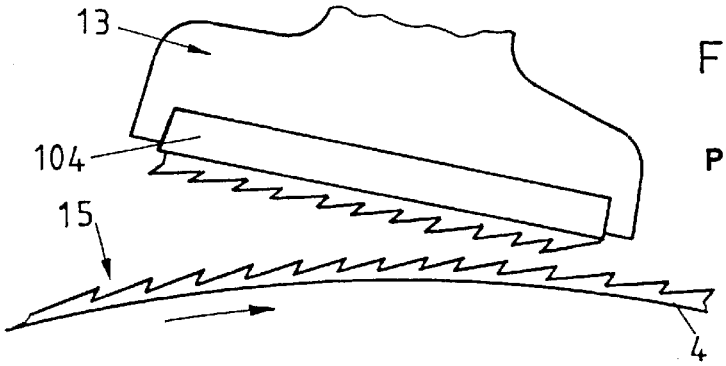
Fig.18 PRIOR ART
FIG. 18 is a schematic view of a conventional flat with a metallic clothing.
Figure 19:
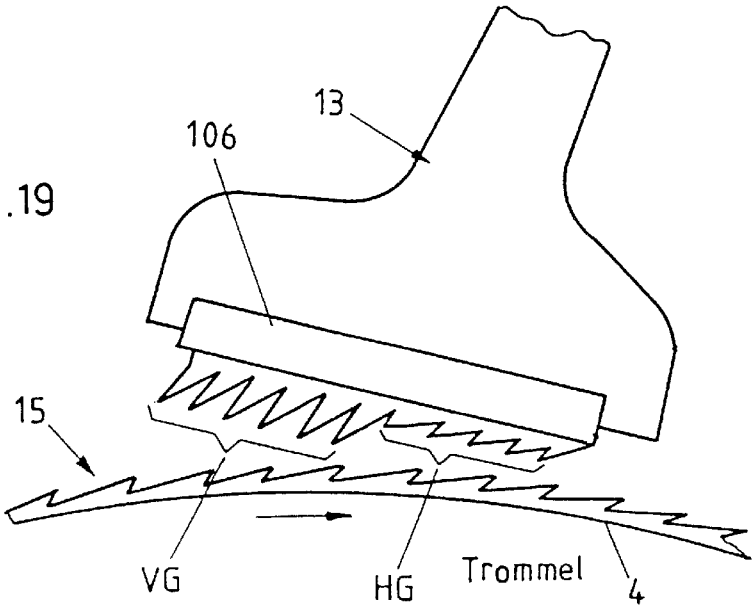
FIG. 19 is a corresponding view of a flat according to the present invention also provided with a metallic clothing.

In the FIG. 18 a flat 13 is shown with a clothing formed by saw tooth wire strips 104, made from steel, arranged side by side (metallic clothing). Each strip 104 (only one strip visible in the FIG. 18) extends transversely to the length of the flat 13. Fastening of the strips 104 to the support portion (flat body) is not shown, but many solutions for this purpose are known, such as e.g. from descriptions in EP-A-91986, or EP-A-422 838 or CH-C-644 900. The flat clothing according to the FIG. 18 is of conventional design (according to the state of the art). In the FIG. 19 a modification is shown according to the present invention in which arrangement each wire strip 106 is provided with two saw tooth groups VG and HG. As the principles have been explained in detail already with reference to the other Figures a further discussion of the metallic clothing variant can be dispensed with, and from the FIG. 19 it should be clearly visible that the present invention is not limited in any way to the application in combination with flexible clothings.

It thus will be obvious also that the present invention is not restricted to the application in a revolving flat card, and in the revolving flats of a revolving flat card respectively. It can be applied as well in a fixed flat, e.g. in a carding segment according to EP-B-431 482.

In the FIG. 20 two flat profiles are shown one of which (shown to the left hand side in the FIG. 20) is copied from the above mentioned U.S. Pat. No. 5,542,154 (FIG. 11 of the US cited patent). According to the US patent the ratio of the total height "h" of the flat to the width "a" of the portion taking up the clothing should be below 2:1, i.e. generally a "low" flat profile is aimed at. The height of the flat profile determines a minimum "height" H1 (FIG. 21) of the revolving flat assembly with a corresponding line of action W (FIG. 21) of the drive belt for this assembly.

The patent application EP-988 100 88.9 (and U.S. Ser. No. 09/028,425 respectively) describes a card with a working width of more than 1000 mm, e.g. of 1200 mm or more (possibly even more than 1600 mm) aimed at increased card production rates, such "large cards" also being known from the state of the art . An increase of the working width can be effected in a manner meeting the requirements of practical use only if at the same time the quality of the product (of the fibre sliver) is maintained at least equal. Unchanged quality, however, implies precision of the carding gap not merely in the lateral margin zones where the flats are guided on the lateral frames but over the full (increased) working width. Thus a problem arises due to the risk of bending in the middle section of the flat. For overcoming this problem the flat is to be designed for increased structural stability and stiffness. New materials can bring the desired effect, but they would entail major cost problems still today. A broader flat would be more stable, but it would create other problems concerning the achievement of an optimum carding gap. It thus will be necessary to design an "extended" flat with a higher profile than in a conventional flat as indicated schematically in the FIG. 20 by the height h1 of the flat shown to the right hand side.

Consequently a higher revolving flat arrangement results and thus a longer action line W1 of the flat drive belt (FIG. 21) if the main carding zone is to remain unchanged. At every place along the flat drive belt a flat must be placed—no gaps are to be provided between the flats. An assembly of this type thus comprises more (technologically redundant) flats and is correspondingly expensive in manufacturing as well as in maintenance.

Application of the present invention permits a solution in which the number of flats in the main carding zone is reduced but the number of carding edges, and carding lines respectively, provided is maintained (or is even increased). The action line of the flat drive belt thus can be reduced to W2 (FIG. 21). If the main drum diameter remains unchanged a smaller main carding zone results which can be made use of for placing auxiliary aggregates (e.g. fixed flats or trash removal devices) in the room thus freed.

A great number of proposals have been presented for optimising the arrangement of the individual wire hooks or wire elements in the flat clothing. Examples thereof are:

U.S. Pat. No. 3,808,640 (Graf)—Changes in the "pointing" angle and/or the "combing" angle over the width of the strip.

DE-Utility Model 14 86 385 (Seelemann)—the density of the "needling" of the flat clothing is to be lighter than the "needling" of the main drum clothing in which arrangement the flats alternatingly can be provided with higher and lower needling density. The latter idea also has been stated also in DE-A-22 26 914.

The point density is to be changed within a group of points.

Variants of this idea have been shown in BE-A-588 694; DE-A-26 17 796; DE-A-33 18 580; DE-A-33 36 825; DE-A-41 25 035 and EP-A-431 379 (where some clothings are provided on fixed flats and in some cases metallic clothing is provided).

The various arrangements can be applied also in combination with a card according to the present invention.

The preferred embodiment according to the present invention comprises only two groups of points per flat, each group having one respective (own) clothing plane per flat. The clothing of the flat correspondingly contains a "height discontinuity" where the groups meet, at which place a gap provided additionally in the clothing can form an additional discontinuity. At the discontinuity (with or without a gap) preferentially a web bridge forms. The same effect of course can be achieved in every "transition zone" if more than two groups of points are provided. With an increasing number of groups it will be increasingly difficult to ensure application of an adequate number of wire rows per group if a rational flat width is to be maintained.

The dimension of the "discontinuity" is in part a function of the geometry of the clothing planes. It also is influenced by the main drum diameter, a smaller main drum diameter resulting in a larger discontinuity. As a measure for the discontinuity, the height difference Z (FIG. 10B) can be considered which results between the clothing planes in the transition zone. This height difference corresponds to the distance between the clothing planes E1, E2 if these planes extend parallel. The height difference Z preferentially ranges between 0,1 and 0,3 mm for cards of a main drum diameter of 1000 mm to 1250 mm, and between 0,2 and 0,5 mm for cards of a main drum diameter ranging between 700 mm and 900 mm.

Flat clothing wires normally are inserted in "wire rows". A conventional flat contains about 25 wire rows, although the Patent Application EP-98810526.8 shows a possibility of increasing the number of wire rows per flat. A "group of points" according to the present invention preferentially comprises at least four and preferably six to twelve wire rows in which arrangement still more wire rows per group are feasible under certain circumstances (e.g. if finer wires are used).

What is claimed is:

1. A flat for use in a revolving flat card assembly, said flat comprising at least two groups of clothing points; each of said groups of points defining a clothing plane for its said respective group of points; and each of said groups comprising a heel zone with respect to its said clothing plane such that at least two distinct clothing planes with respective distinct heel zones are provided.

2. The flat as in claim 1, wherein at least one of said heel zones defines an essentially flat plane angled at a non-zero angle with respect to its said respective clothing plane.

3. The flat as in claim 1, wherein at least one of said heel zones defines a curved plane angled with respect to its said respective clothing plane.

4. The flat as in claim 1, further comprising a height transition zone between said groups of points such that said clothing planes are offset heightwise with respect to each other.

5. The flat as in claim 4, wherein said height transition zone is defined by a difference in height between wires of each said group of points.

6. The flat as in claim 1, wherein said groups of points are supported on a common support portion.

7. The flat as in claim 1, wherein each said group of points are supported on a base member attached to a common support portion, each of said groups of points comprising a clothing parameter from the group of wire length, wire thickness, wire height, clothing point density, wire arrangement pattern, and base thickness that is different from that of said other respective group of points.

8. The flat as in claim 1, further comprising a gap defined between said groups of points.

9. A flat for use in a revolving flat card assembly, said flat comprising at least two groups of clothing points; each of said groups of points defining a clothing plane for its said respective group of points; and each of said groups comprising a heel zone defined at an angle with respect to said clothing Diane of said respective group; a height transition zone between said groups of points such that said clothing planes are offset heightwise with respect to each other; and wherein said height transition zone is defined by a step.

10. A flat for use in a revolving flat card assembly, said flat comprising at least two groups of clothing points; each of said groups of points defining a clothing plane for its said respective group of points; and each of said groups comprising a heel zone defined at an angle with respect to said clothing plane of said respective group; and wherein said flat defines a clothing area exceeding about 1000 mm in length.

11. The flat as in claim 10, further comprising a step defined at a height transition zone between said groups of points, said base conforming to said step.

12. The flat as in claim 11, wherein said base comprises a flexible element common to said groups of points.

13. A flat for use in a revolving flat card assembly, said flat comprising at least two groups of clothing points; each of said groups of points defining a clothing plane for its said respective group of points; and each of said groups comprising a heel zone defined at an angle with respect to said clothing plane of said respective group; and wherein said groups of points are supported on a common base.

14. A flat for use in a revolving flat card assembly, said flat comprising at least two groups of clothing points; each of said groups of points defining a clothing plane for its said respective group of points; and each of said groups comprising a heel zone defined at an angle with respect to said clothing plane of said respective group; wherein said groups of points are supported on a common support portion; and wherein said support portion defines a step at a height transition zone between said groups of points.

15. The flat as in claim 14, wherein said support portion comprises at least two parts fastened together to define said common support portion.

16. The flat as in claim 14, wherein said groups of points are supported on a common base attached to said support portion, said base being flexible so as to conform to said step of said support portion.

17. A flat for use in a revolving flat card assembly, said flat comprising at least two adjacent groups of clothing points, each of said groups of clothing points comprising its own distinct heel zone; and a height transition zone defined between each of said groups of points such that each said group of points defines a clothing plane that is offset heightwise from a respective said clothing plane of its neighboring said respective group of points.

18. The flat as in claim 17 wherein each of said groups of points further comprises a heel zone defined at an angle with respect to said clothing plane of said respective group.

19. The flat as in claim 18, wherein at least one of said heel zones defines an essentially flat plane angled with respect to its said respective clothing plane.

20. The flat as in claim 18, wherein at least one of said heel zones defines a curved plane angled with respect to its said respective clothing plane.

21. The flat as in claim 17, wherein said height transition zone is defined by a difference in height between wires of each said group of points.

22. The flat as in claim 17, wherein said groups of points are supported on a common base.

23. The flat as in claim 17, wherein said groups of points are supported on a common support portion.

24. The flat as in claim 17, further comprising a gap defined between said groups of points.

25. A flat for use in a revolving flat card assembly, said flat comprising at least two adjacent groups of clothing points; and a height transition zone defined between each of said groups of points such that each said group of points defines a clothing plane that is offset heightwise from a respective said clothing plane of its neighboring said respective group of points; and wherein said height transition zone is defined by a step.

26. A flat for use in a revolving flat card assembly, said flat comprising at least two adjacent groups of clothing points; and a height transition zone defined between each of said groups of points such that each said group of points defines a clothing plane that is offset heightwise from a respective said clothing plane of its neighboring said respective group of points; wherein said groups of points are supported on a common base; and further comprising a step defined at said height transition zone between said groups of points, said base conforming to said step.

27. The flat as in claim 26, wherein said base comprises a flexible element common to said groups of points.

28. A flat for use in a revolving flat card assembly, said flat comprising at least two adjacent groups of clothing points; and a height transition zone defined between each of said groups of points such that each said group of points defines a clothing plane that is offset heightwise from a respective said clothing plane of its neighboring said respective group of points; wherein said groups of points are supported on a common support portion; and wherein said support portion defines a step at said height transition zone between said groups of points.

29. The flat as in claim 28, wherein said support portion comprises at least two parts fastened together to define said common support portion.

30. The flat as in claim 28, wherein said groups of points are supported on a common base attached to said support portion, said base being flexible so as to conform to said step of said support portion.

31. The flat as in claim 28, wherein each said group of points are supported on a base member attached to a common support portion, each of said groups of points comprising a clothing parameter from the group of wire length, wire thickness, wire height, clothing point density, wire arrangement pattern, and base thickness that is different from that of said other respective group of points.

32. A flat for use in a revolving flat card assembly, said flat comprising a common support portion; at least two adjacent clothing strips arranged side by side longitudinally on said support portion; each said strip comprising a different group of clothing points extending from a base; and wherein said groups of clothing points are distinguishable by any combination of clothing Parameters from the group of spacing between groups of adjacent clothing points, wire length, wire thickness, wire height, clothing point density, wire arrangement pattern, and base thickness; a height transition zone between said groups of points such that said clothing planes are offset heightwise with respect to each other; and wherein said height transition zone is defined by a step.

33. A flat for use in a revolving flat card assembly, said flat comprising a common support portion; at least two adjacent clothing strips arranged side by side longitudinally on said support portion; each said strip comprising a different group of clothing points extending from a base; and wherein said groups of clothing points are distinguishable by any combination of clothing parameters from the group of spacing between groups of adjacent clothing points, wire length, wire thickness, wire height, clothing point density, wire arrangement pattern, and base thickness; a height transition zone between said groups of points such that said clothing planes are offset heightwise with respect to each other; and wherein said height transition zone is defined by a difference in height between wires of each said group of points.

34. A flat for use in a revolving flat card assembly, said flat comprising a common support portion; at least two adjacent clothing strips arranged side by side longitudinally on said support portion; each said strip comprising a different group of clothing points extending from a base; and wherein said groups of clothing points are distinguishable by any combination of clothing parameters from the group of spacing between groups of adjacent clothing points, wire length, wire thickness, wire height, clothing point density, wire arrangement pattern, and base thickness; and further comprising a step defined at a height transition zone between said groups of points, said base comprising a flexible element conforming to said step.

35. A flat for use in a revolving flat card assembly, said flat comprising a common support portion; at least two adjacent clothing strips arranged side by side longitudinally on said support portion; each said strip comprising a different group of clothing points extending from a base; and wherein each said group of clothing points comprises relatively coarse wires in a front group and relatively thin wires in a back group wherein said front group of coarser wires contact fibers to be carded before said back group of finer wires; wherein each of said groups of points defines a clothing plane for its said respective group of points, and further comprising a height transition zone between said groups of points such that said clothing planes are offset heightwise with respect to each other; and wherein said height transition zone is defined by a step.

36. A flat for use in a revolving flat card assembly, said flat comprising a common support portion; at least two adjacent clothing strips arranged side by side longitudinally on said support portion; each said strip comprising a different group of clothing points extending from a base; and wherein each said group of clothing points comprises relatively coarse wires in a front group and relatively thin wires in a back group wherein said front group of coarser wires contact fibers to be carded before said back group of finer wires; wherein said clothing strips are supported on a common said base; and further comprising a step defined at a height transition zone between said groups of points, said base comprising a flexible element conforming to said step.

* * * * *